US010230191B2

(12) United States Patent
Lui et al.

(10) Patent No.: US 10,230,191 B2
(45) Date of Patent: Mar. 12, 2019

(54) HIGH-CURRENT ELECTRICAL CONNECTOR WITH MULTI-POINT CONTACT SPRING

(71) Applicant: Aptiv Technologies Limited, St. Michael (BB)

(72) Inventors: Hoi Lui, Warren, OH (US); James M. Rainey, Warren, OH (US); Patrick Joseph Reedy, Youngstown, OH (US)

(73) Assignee: APTIV TECHNOLOGIES LIMITED (BB)

( * ) Notice: Subject to any disclaimer, the term of this patent is extended or adjusted under 35 U.S.C. 154(b) by 0 days.

(21) Appl. No.: 15/724,682

(22) Filed: Oct. 4, 2017

(65) Prior Publication Data

US 2019/0044267 A1 Feb. 7, 2019

Related U.S. Application Data

(60) Provisional application No. 62/539,656, filed on Aug. 1, 2017.

(51) Int. Cl.

| | |
|---|---|
| ***H01R 13/187*** | (2006.01) |
| ***H01R 13/28*** | (2006.01) |
| ***H01R 13/11*** | (2006.01) |
| ***H01R 43/16*** | (2006.01) |

(Continued)

(52) U.S. Cl.

CPC ..... *H01R 13/187* (2013.01); *H01R 13/052* (2013.01); *H01R 13/113* (2013.01);

(Continued)

(58) Field of Classification Search

CPC .... H01R 13/052; H01R 13/113; H01R 13/15; H01R 13/187; H01R 13/28; H01R 13/44;

(Continued)

(56) References Cited

U.S. PATENT DOCUMENTS 5,009,606 A * 4/1991 Villeneuve ..... H01R 12/714 439/59

6,276,960 B1 * 8/2001 Schaefer ..... H01R 11/287 439/466

(Continued)

*Primary Examiner* — Chandrika Prasad

(74) *Attorney, Agent, or Firm* — Joseph Victor Bonadies

(57) ABSTRACT

A high-current electrical connector includes a female electrical-terminal and a contact-spring. The female electrical-terminal is configured to receive a male electrical-terminal and is formed of a single piece of electrically conductive material. The female electrical-terminal has a first-sidewall and a second-sidewall. The second-sidewall defines a distal-end, a proximal-end, and a medial-zone. The first-sidewall is opposite and parallel to the distal-end of the second-sidewall. The contact-spring is formed of a single piece of electrically conductive material disposed intermediate to the first-sidewall and the second-sidewall. The contact-spring defines a plurality of opposed-pair contact-beams. Each of the opposed-pair contact-beams have a plurality of outer-contact-points and a plurality of inner-contact-points. The plurality of outer-contact-points are in contact with the female electrical-terminal, and the plurality of inner-contact-points contact opposed sides of the male electrical-terminal. Contact is formed between the contact-beam, the female electrical-terminal, and the male electrical-terminal in at least four separate locations.

24 Claims, 7 Drawing Sheets

(51) Int. Cl.

| | |
|---|---|
| ***H01R 13/44*** | (2006.01) |
| ***H01R 24/66*** | (2011.01) |
| ***H01R 13/53*** | (2006.01) |
| ***H01R 13/05*** | (2006.01) |
| *H01R 13/66* | (2006.01) |
| *H01R 13/633* | (2006.01) |

(52) U.S. Cl.
CPC ..... *H01R 13/28* (2013.01); *H01R 13/44* (2013.01); *H01R 13/53* (2013.01); *H01R 24/66* (2013.01); *H01R 43/16* (2013.01); *H01R 13/6335* (2013.01); *H01R 13/6683* (2013.01)

(58) Field of Classification Search
CPC ..... H01R 13/53; H01R 24/66; H01R 43/16; H01R 4/4818
USPC ..... 439/842, 843, 845, 852
See application file for complete search history.

(56) References Cited

U.S. PATENT DOCUMENTS

| | | | | |
|---|---|---|---|---|
| 6,589,084 | B1 * | 7/2003 | Frank | H01R 4/64 439/620.26 |
| 6,692,316 | B2 | 2/2004 | Hsieh et al. | |
| 6,945,826 | B2 | 9/2005 | Wise | |
| 7,955,110 | B1 * | 6/2011 | Kataoka | H01R 13/6215 439/284 |
| 8,298,022 | B2 | 10/2012 | Tsuruta et al. | |
| 8,668,531 | B2 * | 3/2014 | Yamaguchi | H01R 13/187 439/843 |
| 8,827,754 | B2 * | 9/2014 | Lee | H01R 13/113 439/843 |
| 9,343,834 | B2 * | 5/2016 | Tokuhara | H01R 13/04 |
| 9,647,372 | B2 | 5/2017 | Eckel | |
| 2016/0064849 | A1 | 3/2016 | Eckel | |

* cited by examiner

HIGH-CURRENT ELECTRICAL CONNECTOR WITH MULTI-POINT CONTACT SPRING

CROSS-REFERENCE TO RELATED APPLICATION

This application claims the benefit under 35 U.S.C. § 119(e) of U.S. Provisional Patent Application No. 62/539,656, filed Aug. 1, 2017, the entire disclosure of which is hereby incorporated herein by reference.

TECHNICAL FIELD OF INVENTION

This disclosure generally relates to an electrical connector, and more particularly relates to an electrical connector that is capable of transferring electrical current in excess of 200 Amperes.

BACKGROUND OF INVENTION

It is known to use electrical connectors capable of transferring electrical current in excess of 100 Amperes (100 A) in electric vehicles (EVs) and hybrid-electric vehicles (HEVs). As non-EVs and non-HEVs become increasingly electrified to reduce greenhouse gasses, electrical connectors require increasingly robust, reliable, and safe designs.

High current connectors have used torsional contact beams to increase the contact force between male and female electrical terminals. These contact beams have typically only had two contact points on each beam. Increasing electrical current carrying capacity of these connector designs is typically accomplished by increasing the number of beams to increase the number of contact points which will cause an undesirable increase in the size of the terminal components, making the resulting connector systems more difficult to package within a vehicle. Therefore, a high current electrical connector that has increased current capacity without increased size remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

In accordance with one embodiment, a high-current electrical connector is provided. The high-current electrical connector includes a female electrical-terminal and a contact-spring. The female electrical-terminal is configured to receive a male electrical-terminal and is formed of a single piece of electrically conductive material. The female electrical-terminal has a first-sidewall and a second-sidewall. The second-sidewall defines a distal-end, a proximal-end, and a medial-zone disposed therebetween. The first-sidewall is opposite and parallel to the distal-end of the second-sidewall. The contact-spring is formed of a single piece of electrically conductive material disposed intermediate to the first-sidewall and the second-sidewall. The contact-spring defines a plurality of opposed-pair contact-beams. Each of the plurality of opposed-pair contact-beams have a plurality of outer-contact-points in electrical and physical contact with the female electrical-terminal, and have a plurality of inner-contact-points. The plurality of inner-contact-points are in electrical and physical contact with opposed sides of the male electrical-terminal. Electrical and physical contact is formed between the contact beam, the female electrical-terminal, and the male electrical-terminal in at least four separate locations.

The male electrical-terminal includes a planar blade-shaped portion formed of an electrically conductive material and has two exposed-edges of the planar blade-shaped portion formed of a dielectric material. The dielectric material is integrally formed with a header-wall and a base of a male-connector.

The plurality of opposed-pair contact-beams are characterized as having a sinusoidally shaped cross-section. The plurality of inner-contact-points and the plurality of outer-contact-points are characterized as having a rounded shape. The contact-spring includes a pair of opposing guide-ribs formed in leading-edges of the contact-spring. The guide-ribs are configured to engage and align the male electrical-terminal upon insertion into the female electrical-terminal. The guide-ribs reduce a transverse-movement of the male electrical-terminal when the male electrical-terminal is in a seated-position. The contact-spring is characterized as having a U-shape.

The female electrical-terminal further includes a third-sidewall that extends from a medial-edge of the first-sidewall to the medial-zone of the second-sidewall. The third-sidewall is in electrical and physical communication with the medial-zone of the first-sidewall. The third-sidewall is joined to the medial-zone by a single clinch-rivet.

In another embodiment, a female terminal assembly, is provided. The female terminal assembly includes a female electrical-terminal and a contact-spring. The female electrical-terminal is formed of a single piece of electrically conductive material. The female electrical-terminal has a first-sidewall and a second-sidewall. The second-sidewall defines a distal-end, a proximal-end, and a medial-zone disposed therebetween. The first-sidewall is opposite and parallel to the distal-end of the second-sidewall. The contact-spring is formed of a single piece of electrically conductive material disposed intermediate to the first-sidewall and the second-sidewall. The contact-spring defines a plurality of opposed-pair contact-beams. Each of the plurality of opposed-pair contact-beams have a plurality of outer-contact-points in electrical and physical contact with the female electrical-terminal, and have a plurality of inner-contact-points. The plurality of inner-contact-points are in electrical and physical contact with opposed sides of the male electrical-terminal. Electrical and physical contact is formed between the contact beam, the female electrical-terminal, and the male electrical-terminal in at least four separate locations.

The plurality of opposed-pair contact-beams are characterized as having a sinusoidally shaped cross-section. The plurality of inner-contact-points and the plurality of outer-contact-points are characterized as having a rounded shape. The contact-spring includes a pair of opposing guide-ribs formed in leading-edges of the contact-spring. The guide-ribs are configured to engage and align the male electrical-terminal upon insertion into the female electrical-terminal. The guide-ribs reduce a transverse-movement of the male electrical-terminal when the male electrical-terminal is in a seated-position. The contact-spring is characterized as having a U-shape.

The female electrical-terminal further includes a third-sidewall that extends from a medial-edge of the first-sidewall to the medial-zone of the second-sidewall. The third-sidewall is in electrical and physical communication with the medial-zone of the first-sidewall. The third-sidewall is joined to the medial-zone by a single clinch-rivet.

In yet another embodiment, a contact-spring is provided. The contact-spring is formed of a single piece of electrically conductive material configured to be disposed within a female electrical-terminal. The contact-spring defines a plurality of opposed-pair contact-beams. Each of the plurality of opposed-pair contact-beams have a plurality of outer-contact-points and a plurality of inner-contact-points. The plurality of outer-contact points are configured to be in electrical and physical contact with the female electrical-terminal. The plurality of inner-contact-points are configured to be in electrical and physical contact with opposed sides of a male electrical-terminal. Electrical and physical contact is formed between the contact beam, the female electrical-terminal, and the male electrical-terminal in at least four separate locations.

The plurality of opposed-pair contact-beams are characterized as having a sinusoidally shaped cross-section. The plurality of inner-contact-points and the plurality of outer-contact-points are characterized as having a rounded shape. The contact-spring includes a pair of opposing guide-ribs formed in leading-edges of the contact-spring. The guide-ribs are configured to engage and align the male electrical-terminal upon insertion into the female electrical-terminal. The guide-ribs reduce a transverse-movement of the male electrical-terminal when the male electrical-terminal is in a seated-position. The contact-spring is characterized as having a U-shape.

In yet another embodiment, a female terminal assembly includes a female electrical-terminal and a contact-spring. The female electrical-terminal is formed of a single piece of electrically conductive material. The female electrical-terminal has a first-sidewall, a second-sidewall, and a third-sidewall. The second-sidewall defines a distal-end, a proximal-end, and a medial-zone disposed between the distal-end and the proximal-end. The first-sidewall is opposite and parallel to the distal-end of the second-sidewall. The third-sidewall extends from a medial-edge of the first-sidewall and contacts the second-sidewall from the medial-zone to the proximal-end. The third-sidewall is in electrical and physical communication with the first-sidewall.

The contact-spring is formed of a single piece of electrically conductive material disposed intermediate to the first-sidewall and the second-sidewall. The contact-spring defines a plurality of opposed-pair contact-beams. Each of the plurality of opposed-pair contact-beams have a plurality of outer-contact-points and have a plurality of inner-contact-points. The plurality of outer-contact-points are in electrical and physical contact with the female electrical-terminal. The plurality of inner-contact-points are in electrical and physical contact with opposed sides of the male electrical-terminal. Electrical and physical contact is formed between the contact beam, the female electrical-terminal, and the male electrical-terminal in at least four separate locations.

The third-sidewall defines a plurality of weld-slots longitudinally extending from the medial-zone to the proximal-end. The weld-slots are configured to interface with an electrical-cable sonically welded to the female terminal.

The plurality of opposed-pair contact-beams are characterized as having a sinusoidally shaped cross-section. The plurality of inner-contact-points and the plurality of outer-contact-points are characterized as having a rounded shape. The contact-spring includes a pair of opposing guide-ribs formed in leading-edges of the contact-spring. The guide-ribs are configured to engage and align the male electrical-terminal upon insertion into the female electrical-terminal. The guide-ribs reduce a transverse-movement of the male electrical-terminal when the male electrical-terminal is in a seated-position. The contact-spring is characterized as having a U-shape.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

The reference numbers of similar elements in the embodiments shown in the various figures share the last two digits.

DETAILED DESCRIPTION

An electrical connector capable of carrying currents in excess of 200 Amperes, and in some cases in excess of 400 Amperes, is presented herein. This invention uses a contact insert with quadruple contact points on each contact beam for increasing the electrical current carrying capability of the connector. This electrical connector may also include a clinching joint to increasing the rigidity of the terminal box without affecting the cable welding area.

Figure 1:
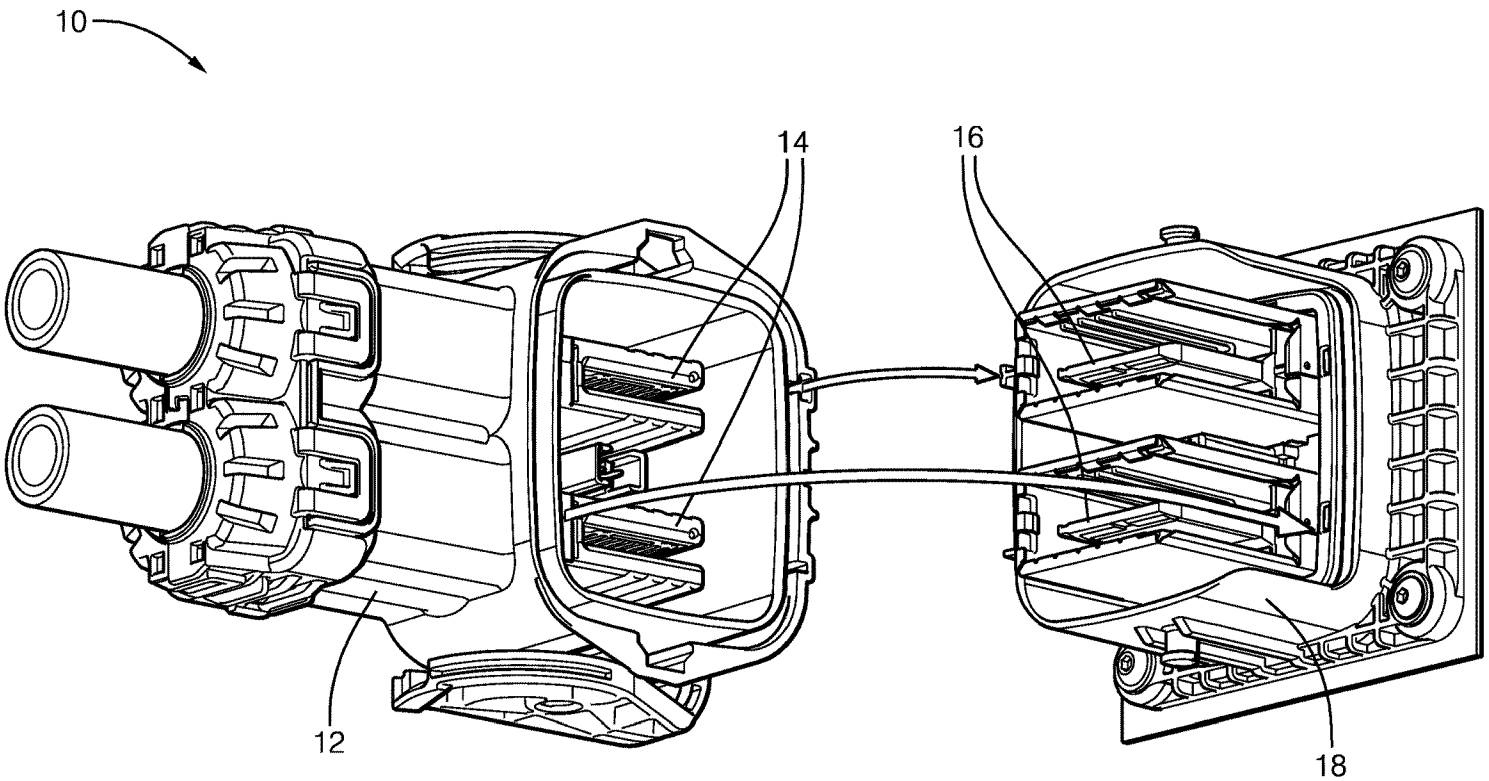
FIG. 1 is an illustration of a high-current electrical connector with a female-connector separated from a male-connector in accordance with one embodiment.

FIG. 1 illustrates a non-limiting example of a high-current electrical connector 10, hereafter referred to as the connector 10. The connector 10 is shown in the un-mated condition to illustrate the internal components, as will be described in more detail below. The connector 10 includes female-connector 12 having a female electrical-terminal 14 configured to receive a male electrical-terminal 16 disposed within a male-connector 18. The male electrical-terminal 16 may be a planar-type terminal with two exposed sides, and is formed of an electrically conductive material, such as a copper-based alloy that may also include a coating of another conductive material (e.g. tin-based, silver-based coating). The male electrical-terminal 16 may include a non-conductive material covering edges of the electrically conductive material.

Figure 2:
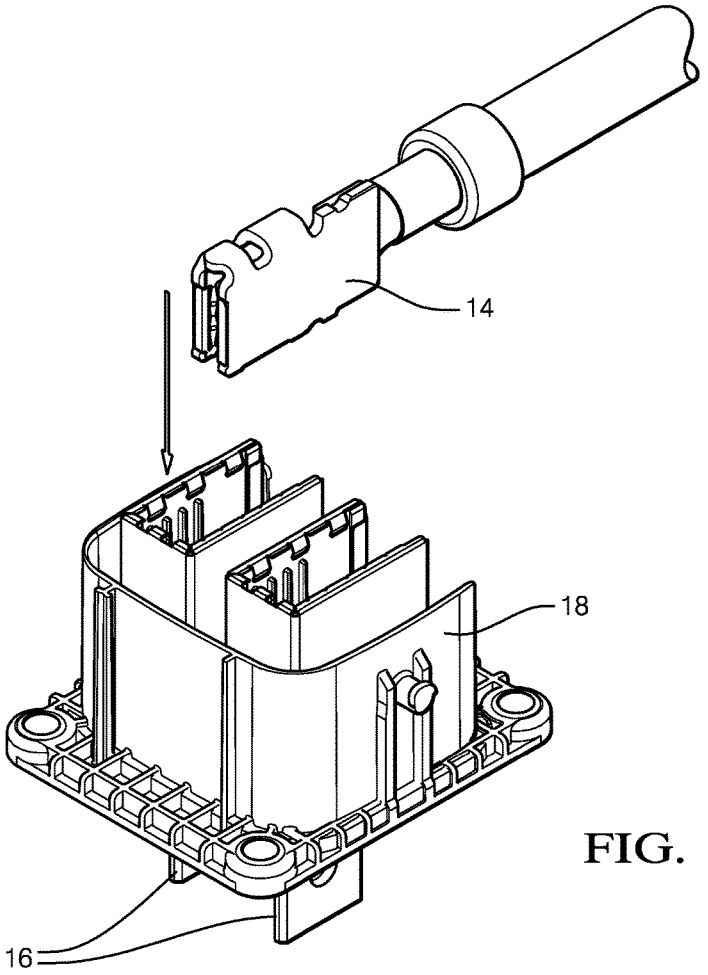
FIG. 2 is an exploded view of an illustration of a female electrical-terminal and a male electrical-terminal of FIG. 1 in accordance with one embodiment.

FIG. 2 illustrates one female electrical-terminal 14 isolated from the female-connector 12 that is shown positioned above the mating male-connector 18. The female electrical-terminal 14 may include a housing (not shown) composed of a dielectric material 58 that is configured to engage retention devices (not shown) within the female-connector 12. The female electrical-terminal 14 is shown attached to an electrical-cable that may connect to electrical-circuits elsewhere in an electrical-system of a vehicle. The electrical-cable is attached to the female electrical-terminal 14 by a sonic welding process. Alternate embodiments may be envisioned in which other known welding processes are used to attach the electrical-cable to the female electrical-terminal 14.

Figure 3:
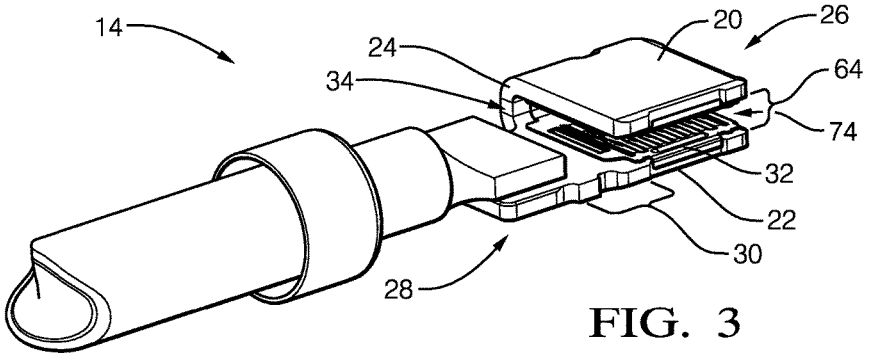
FIG. 3 is an illustration of the female electrical-terminal of FIG. 2 in accordance with one embodiment.

FIG. 3 illustrates the female electrical-terminal 14 of FIG. 2 in a side-view to expose internal components. The female electrical-terminal 14 is formed of a single piece of electrically conductive material, such as a copper-based alloy and may include a coating of another conductive material (e.g. tin-based, silver-based coating). The female electrical-terminal 14 has a first-sidewall 20 and a second-sidewall 22 that are connected by a web 24 of material created during a forming operation. The second-sidewall 22 defines a distal-end 26, a proximal-end 28, and a medial-zone 30 disposed between the distal-end 26 and the proximal-end 28. The first-sidewall 20 is opposite and parallel to the distal-end 26 of the second-sidewall 22 creating a channel 74, 174 (see FIG. 8) configured to receive the two exposed sides of the male electrical-terminal 16 (not shown).

The female electrical-terminal 14 also includes a contact-spring 32 formed of a single piece of electrically conductive material disposed intermediate to the first-sidewall 20 and the second-sidewall 22. The contact-spring 32 is formed of a copper-based alloy and is characterized as having a U-shape 34. The contact-spring 32 may include a conductive coating, such as a tin-based alloy and/or a silver-based alloy. The contact-spring 32 may include retention features (not specifically shown) that engage the female electrical-terminal 14 and inhibit a removal of the contact-spring 32. Alternative embodiments may be envisioned using a different conductive material, such as a steel or aluminum alloy to form the contact-spring 32 which may or not be coated with a conductive coating.

Figure 4C:
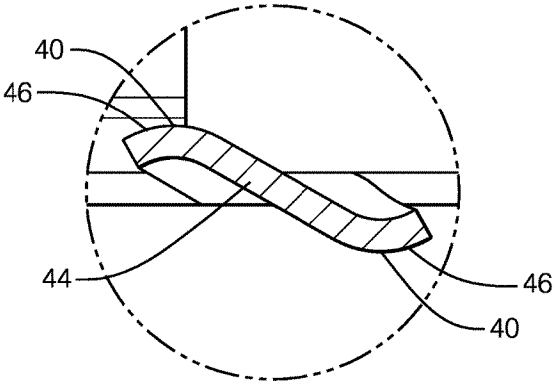
FIG. 4C is an enlarged view of the cross-section of the contact-spring of FIG. 4B in accordance with one embodiment.
Figure 4B:
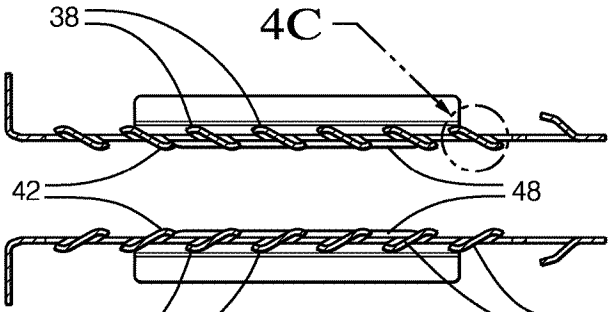
FIG. 4B is an illustration of a cross-section view of the contact-spring of FIG. 4A in accordance with one embodiment.
Figure 4A:
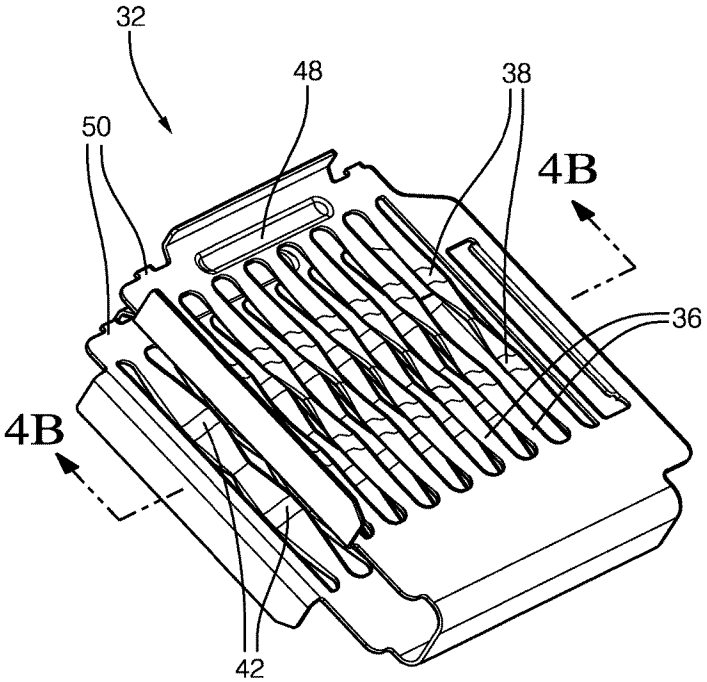
FIG. 4A is an illustration of a contact-spring in accordance with one embodiment.
Figure 6A:
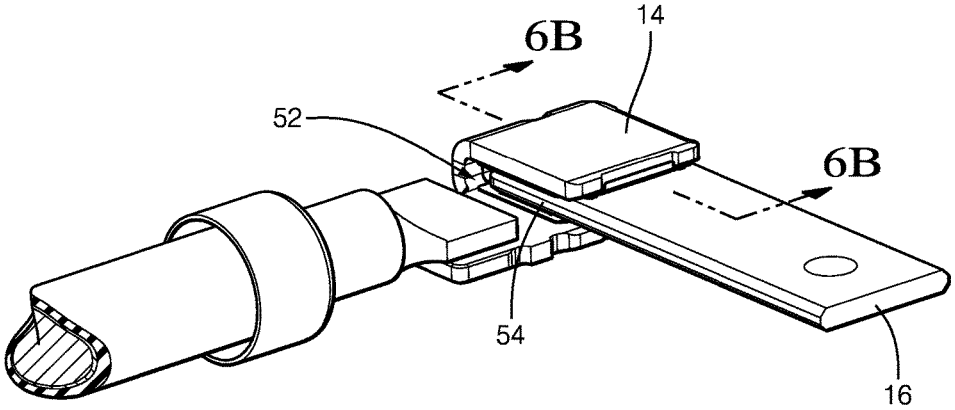
FIG. 6A is an illustration of the female electrical-terminal with a male electrical-terminal in a seated position in accordance with one embodiment.
Figure 6B:
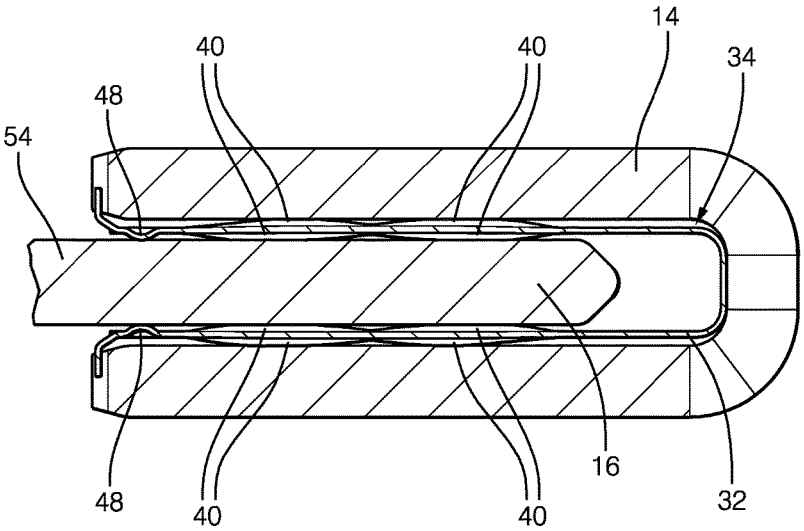
FIG. 6B is a cross-section view of the female electrical-terminal and the male electrical-terminal of FIG. 6A in accordance with one embodiment.

FIGS. 4A-4C illustrate the contact-spring 32 separated from the female electrical-terminal 14. The contact-spring 32 defines a plurality of opposed-pair contact-beams 36, wherein each of the opposed-pair contact-beams 36 have a plurality of outer-contact-points 38 in electrical and physical contact with the female electrical-terminal 14. That is, the outer-contact-points 38 of the contact-spring 32 are in electrical and physical contact with the inner face of the first-sidewall 20 and the inner face of the second-sidewall 22, and each individual contact-beam 36 has at least two contact-points 40 in connection with their respective sidewall (see FIG. 6B). Additionally, each of the opposed-pair contact-beams 36 have a plurality of inner-contact-points 42 that are in electrical and physical contact with opposed sides of the male electrical-terminal 16, and each individual contact-beam 36 has at least two contact-points 40 in connection with each face of the male electrical-terminal 16. As a result, electrical and physical contact is formed between each contact beam 36, the female electrical-terminal 14, and the male electrical-terminal 16 in at least four separate locations, as illustrated in FIGS. 6A-6B.

Returning to FIG. 4C, the plurality of opposed-pair contact-beams 36 may be characterized as having a sinusoidally shaped cross-section 44, and the plurality of inner-contact-points 42 and the plurality of outer-contact-points 38 may be characterized as having a rounded shape 46. Preferably, the contact-beams 36 are formed such that a normal contact-force of between about 2.5 Newtons (2.5 N) to about 8 N is imparted on the male electrical-terminal 16 at each of the contact-points 40 of each individual contact-beam 36. The inventors have discovered that this range of contact-force provides sufficient normal-force to minimize a contact resistance between the male electrical-terminal 16 and the female electrical-terminal 14, while meeting the ergonomic requirements for assemblers.

Figure 5:
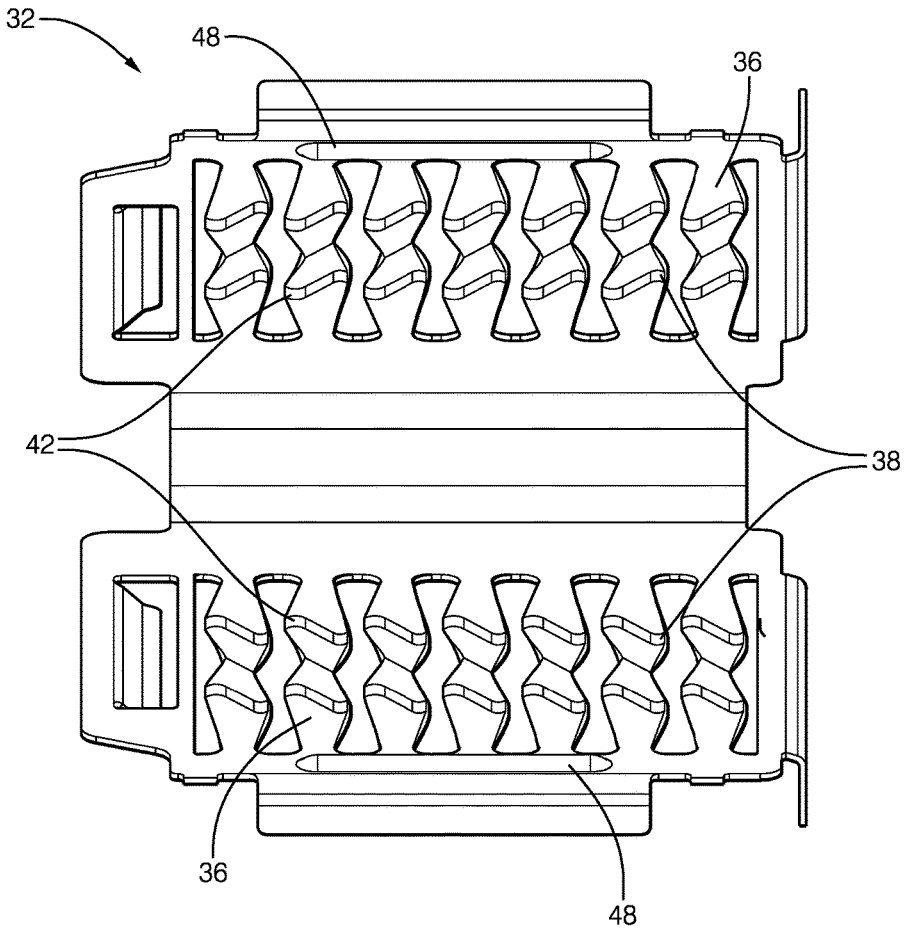
FIG. 5 is an illustration of the contact-spring of FIG. 4A spread open in accordance with one embodiment.

FIG. 5 illustrates the contact-spring 32 spread open to more clearly reveal the geometry of the contact-beams 36, and denotes a bottom-half and top-half for illustration purposes only. The opposed-pair contact-beams 36 are formed such that the inner-contact-points 42 of the contact-beam 36 in the bottom-half lay in a same-plane as the inner-contact-points 42 of the corresponding paired contact-beam 36 in the top-half. This same-plane is illustrated by a dashed-line shown passing through the inner-contact-points 42. While not specifically shown, the outer-contact-points 38 also lay in a same-plane.

Returning to FIG. 4A, the contact-spring 32 may further include a pair of opposing guide-ribs 48 formed in leading-edges 50 of the contact-spring 32. The guide-ribs 48 are configured to engage and align the male electrical-terminal 16 upon insertion into the female electrical-terminal 14 and thereby reduce a transverse-movement of the male electrical-terminal 16 when the male electrical-terminal 16 is in a seated-position 52 (see FIG. 6A). FIGS. 6A-6B illustrate the male electrical-terminal 16 as having a planar blade-shaped portion 54 disposed within the female electrical-terminal 14. The guide-ribs 48 are preferably rounded to reduce the potential for gouging any conductive coating on the male electrical-terminal 16. The guide-ribs 48 are preferably a continuous feature to maximize a contact-area between the contact-spring 32 and the male electrical-terminal 16 for both electrical and structural purposes.

Figure 7:
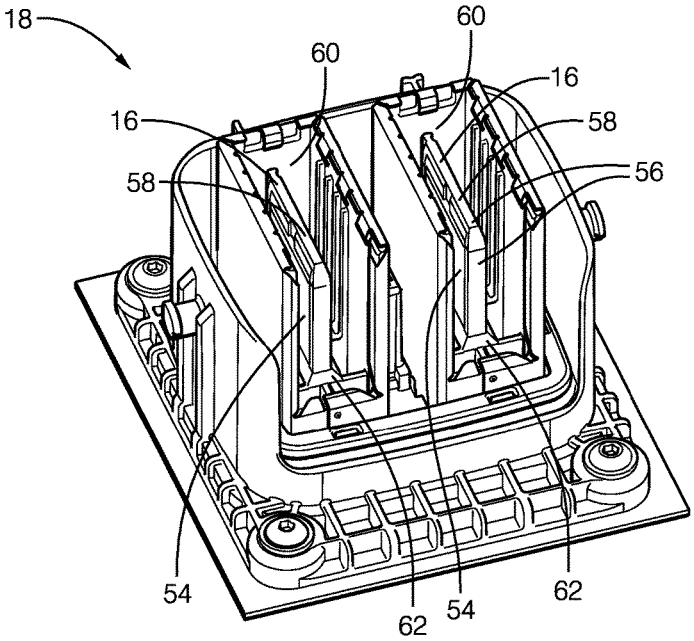
FIG. 7 is an illustration of the male-connector in accordance with one embodiment.

FIG. 7 illustrates a perspective-view of the male-connector 18 from FIG. 1. The male electrical-terminal 16 may include the planar blade-shaped portion 54 that may be formed of an electrically conductive material (e.g. copper-based alloy) and may have two exposed-edges 56 of the planar blade-shaped portion 54 formed of a dielectric material 58. The dielectric material 58 is configured prevent an electrical-shock if a human finger were to contact the exposed-edge 56. The dielectric material 58 may be formed into the male-connector 18, or may be applied separately to the edges of the planar blade-shaped portion 54 of the male electrical-terminal 16. Preferably, the dielectric material 58 is integrally formed with a header-wall 60 and a base 62 of the male-connector 18 to increase a strength and a structural rigidity of the dielectric material 58, with the added benefit of increasing a surface area of electrical connection surfaces without increasing a package-size of the male-connector 18. The integration of the dielectric material 58 to the header-wall 60 is possible due to an open-distal-end 64 of the female electrical-terminal 14 (see FIG. 3).

Figure 8:
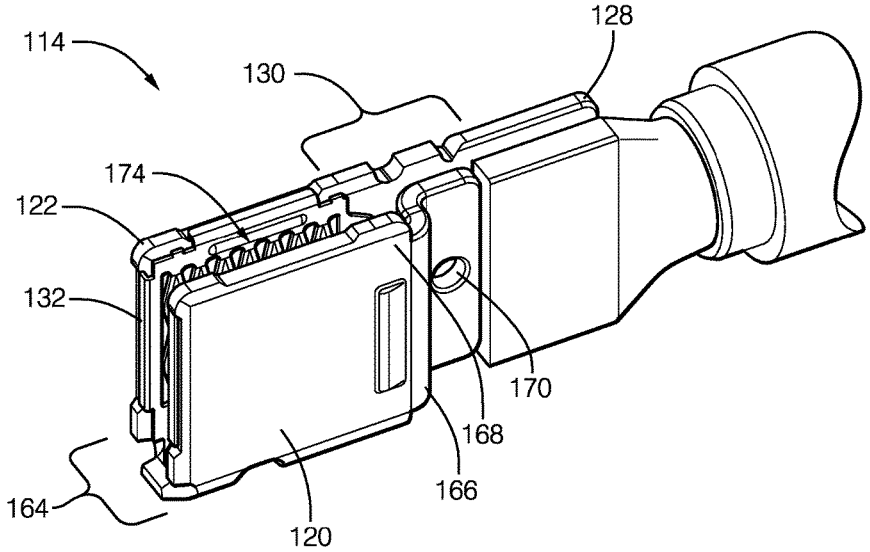
FIG. 8 is an illustration of the female electrical-terminal with a third-sidewall in accordance with another embodiment.

FIG. 8 illustrates an alternative embodiment of a female electrical-terminal 114. The female electrical-terminal 114 further includes a third-sidewall 166 that extends from a medial-edge 168 of the first-sidewall 120 to the medial-zone 130 of the second-sidewall 122 such that the third-sidewall 166 is in electrical and physical communication with the medial-zone 130 of the first-sidewall 120. The third-sidewall 166 provides a more rigid structure to the female electrical-terminal 114 and further provides an additional conductive path, both of which may enable the use of thinner material stock than needed for the female electrical-terminal 14 of FIG. 3 to carry an equivalent electrical current. The third-sidewall 166 may be joined to the medial-zone 130 by a single clinch-rivet 170. Alternative embodiments of the female electrical-terminal 114 may be formed using any of the other known joining methods. The location of the single clinch-rivet 170 in the medial-zone 130 is advantageous because the placement reduces a distortion of the proximal-end 128 of the second-sidewall 122. Experimentation by the inventors has discovered that by not extending the third-sidewall 166 to the edge of the proximal-end 128 of the second-sidewall 122, together with the placement of the single clinch-rivet 170, the quality of a weld joint between the electrical-cable and the female electrical-terminal 114 is greatly improved.

Figure 9:
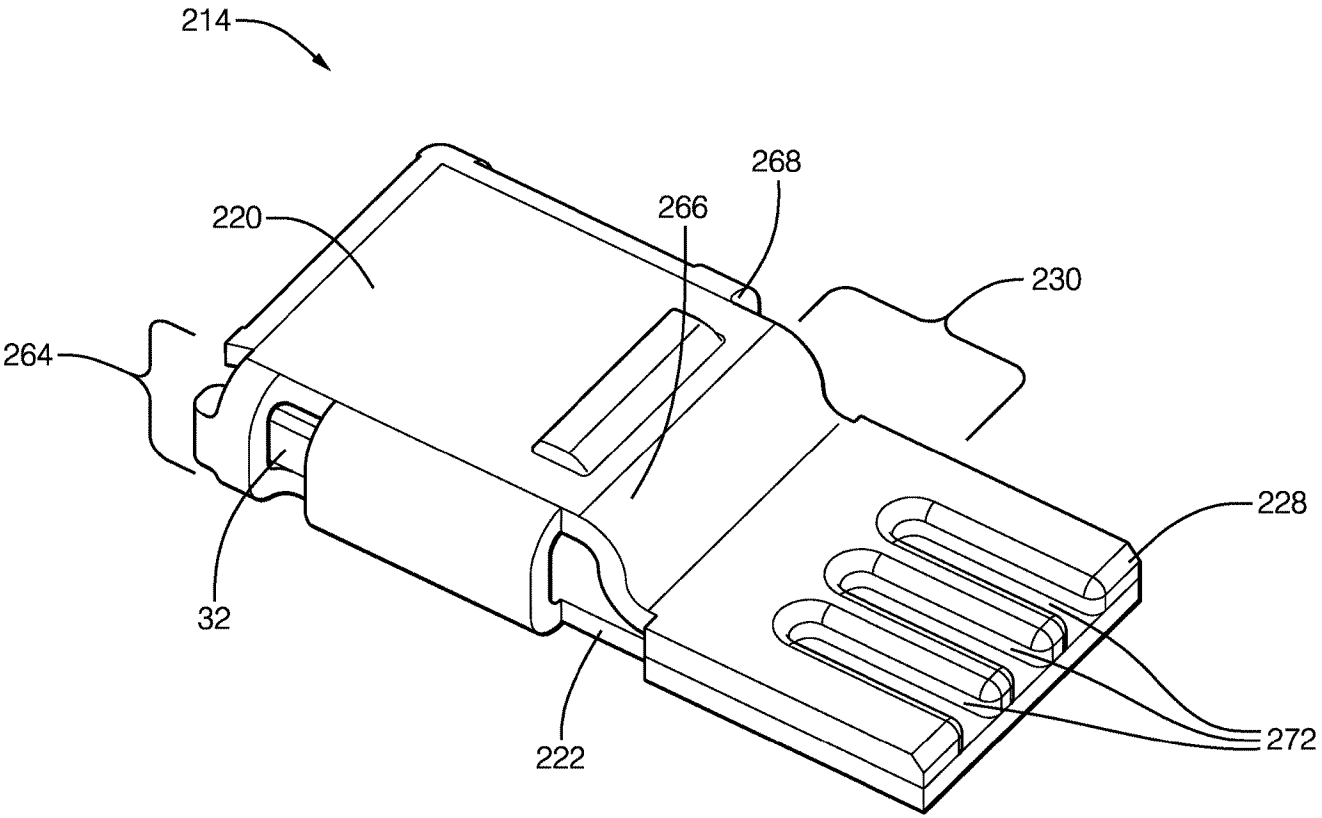
FIG. 9 is an illustration of the female electrical-terminal with the third-sidewall in accordance with yet another embodiment.

FIG. 9 illustrates yet another embodiment of a female electrical-terminal 214. The female electrical-terminal 214 is formed of a single piece of electrically conductive material and has a first-sidewall 220, a second-sidewall 222, and a third-sidewall 266. The second-sidewall 222 defines a distal-end 226, a proximal-end 228, and a medial-zone 230 disposed between the distal-end 226 and the proximal-end 228. The first-sidewall 220 is opposite and parallel to the distal-end 226 of the second-sidewall 222. The third-sidewall 266 extends from a medial-edge 268 of the first-sidewall 220 and contacts the second-sidewall 222 from the medial-zone 230 to the proximal-end 228. The third-sidewall 266 is in electrical and physical communication with the first-sidewall 220.

The third-sidewall 266 defines a plurality of weld-slots 272 longitudinally extending from the medial-zone 230 to the proximal-end 228. The weld-slots 272 are configured to interface with an electrical-cable (not shown) sonically welded to the female electrical-terminal 214. The weld-slots 272 expose a surface of the second-sidewall 222 and enable the electrical-cable to be sonically welded to both the third-sidewall 266 and the second-sidewall 222. The quantity of the plurality of weld-slots 272 and a dimension of the weld-slots 272 may be varied based on a diameter of the electrical-cable and the material thickness of the female electrical-terminal 214.

Accordingly, a high-current electrical connector 10 is provided. The connector 10 is beneficial because the connector 10 increases the number of contact-points 40 between the female electrical-terminal 14 and the male electrical-terminal 16, which may enable a reduction in resistive-heating of the connector 10 during high-current operation.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. A high-current electrical connector, comprising:

a female electrical-terminal configured to receive a male electrical-terminal, said female electrical-terminal formed of a single piece of electrically conductive material, said female electrical-terminal having a first-sidewall and a second-sidewall connected by a web, said second-sidewall defining a distal-end, a proximal-end, and a medial-zone disposed therebetween, wherein the first-sidewall is opposite and parallel to the distal-end of the second-sidewall, and wherein the female electrical-terminal defines an open distal-end and a channel opposite the web to receive the male electrical-terminal;

a contact-spring formed of a single piece of electrically conductive material disposed intermediate to the first-sidewall and the second-sidewall, said contact-spring defines a plurality of opposed-pair contact-beams, wherein each of the plurality of opposed-pair contact-beams have a plurality of outer-contact-points and have a plurality of inner-contact-points, wherein the plurality of outer-contact-points are in electrical and physical contact with the female electrical-terminal, and wherein the plurality of inner-contact-points are in electrical and physical contact with opposed sides of the male electrical-terminal such that a electrical and physical contact is formed between the contact beam, the female electrical-terminal, and the male electrical-terminal in at least four separate locations;

the male electrical-terminal, wherein the male electrical-terminal includes a planar blade-shaped portion formed of an electrically conductive material having two exposed-edges of the planar blade-shaped portion formed of a dielectric material, wherein the dielectric material is integrally formed with a header-wall and a base of a male-connector.

2. The high-current electrical connector in accordance with claim 1, wherein the plurality of opposed-pair contact-beams are characterized as having a sinusoidally shaped cross-section.

3. The high-current electrical connector in accordance with claim 1, wherein the plurality of inner-contact-points and the plurality of outer-contact-points are characterized as having a rounded shape.

4. The high-current electrical connector in accordance with claim 1, wherein the contact-spring further includes a pair of opposing guide-ribs formed in leading-edges of the contact-spring, said pair of opposing guide-ribs configured to engage and align the male electrical-terminal upon insertion into the female electrical-terminal and thereby reduce a transverse-movement of the male electrical-terminal when the male electrical-terminal is in a seated-position.

5. The high-current electrical connector in accordance with claim 1, wherein the contact-spring is characterized as having a U-shape.

6. The high-current electrical connector in accordance with claim 1, wherein the female electrical-terminal further includes a third-sidewall that extends from a medial-edge of the first-sidewall to the medial-zone of the second-sidewall, wherein the third-sidewall is in electrical and physical communication with the medial-zone of the first-sidewall.

7. The high-current electrical connector in accordance with claim 6, wherein the third-sidewall is joined to the medial-zone of the second-sidewall by a single clinch-rivet.

8. A female terminal assembly, comprising:

a female electrical-terminal formed of a single piece of electrically conductive material, said female electrical-terminal having a first-sidewall and a second-sidewall connected by a web, said second-sidewall defining a distal-end, a proximal-end, and a medial-zone disposed therebetween, wherein the first-sidewall is opposite and parallel to the distal-end of the second-sidewall and wherein the female electrical-terminal defines an open distal-end and a channel opposite the web to receive the male electrical-terminal; and a contact-spring formed of a single piece of electrically conductive material disposed intermediate to the first-sidewall and the second-sidewall, said contact-spring defines a plurality of opposed-pair contact-beams, wherein each of the plurality of opposed-pair contact-beams have a plurality of outer-contact-points and have a plurality of inner-contact-points, wherein the plurality of outer-contact-points are in electrical and physical contact with the female electrical-terminal, and wherein the plurality of inner-contact-points are in electrical and physical contact with opposed sides of a male electrical-terminal such that a electrical and physical contact is formed between the contact beam, the female electrical-terminal, and the male electrical-terminal in at least four separate locations.

9. The female terminal assembly in accordance with claim 8, wherein the plurality of opposed-pair contact-beams are characterized as having a sinusoidally shaped cross-section.

10. The female terminal assembly in accordance with claim 8, wherein the plurality of inner-contact-points and the plurality of outer-contact-points are characterized as having a rounded shape.

11. The female terminal assembly in accordance with claim 8 wherein the contact-spring further includes a pair of opposing guide-ribs formed in leading-edges of the contact-spring, said pair of opposing guide-ribs configured to engage and align the male electrical-terminal upon insertion into the female electrical-terminal and thereby reduce a transverse-movement of the male electrical-terminal when the male electrical-terminal is in a seated-position.

12. The female terminal assembly in accordance with claim 8, wherein the contact-spring is characterized as having a U-shape.

13. The female terminal assembly in accordance with claim 8, wherein the female electrical-terminal further includes a third-sidewall that extends from a medial-edge of the first-sidewall to the medial-zone of the second-sidewall, wherein the third-sidewall is in electrical and physical contact with the medial-zone of the first-sidewall.

14. The female terminal assembly in accordance with claim 13, wherein the third-sidewall is joined to the medial-zone of the second-sidewall by a single clinch-rivet.

15. A contact-spring formed of a single piece of electrically conductive material configured to be disposed within a female electrical-terminal, said contact-spring defines a plurality of opposed-pair contact-beams, wherein each of the plurality of opposed-pair contact-beams have a plurality of outer-contact-points and have a plurality of inner-contact-points, wherein the plurality of outer-contact-points are configured to be in electrical and physical contact with the female electrical-terminal, and wherein the plurality of inner-contact-points are configured to be in electrical and physical contact with opposed sides of a male electrical-terminal such that a electrical and physical contact is formed between the contact beam, the female electrical-terminal, and the male electrical-terminal in at least four separate locations, wherein the contact-spring further includes a pair of opposing guide-ribs formed in leading-edges of the contact-spring, said pair of opposing guide-ribs configured to engage and align the male electrical-terminal upon insertion into the female electrical-terminal and thereby reduce a transverse-movement of the male electrical-terminal when the male electrical-terminal is in a seated-position.

16. The contact-spring in accordance with claim 15, wherein the plurality of opposed-pair contact-beams are characterized as having a sinusoidally shaped cross-section.

17. The contact-spring in accordance with claim 15, wherein the plurality of inner-contact-points and the plurality of outer-contact-points are characterized as having a rounded shape.

18. The contact-spring in accordance with claim 15, wherein the contact-spring is characterized as having a U-shape.

19. A female terminal assembly, comprising:

a female electrical-terminal formed of a single piece of electrically conductive material, said female electrical-terminal having a first-sidewall, and a second-sidewall connected by a web, and a third-sidewall, said second-sidewall defining a distal-end, a proximal-end, and a medial-zone disposed therebetween, wherein the first-sidewall is opposite and parallel to the distal-end of the second-sidewall, wherein the third-sidewall extends from a medial-edge of the first-sidewall and contacts the second-sidewall from the medial-zone to the proximal-end, wherein the third-sidewall is in electrical and physical communication with the first-sidewall, and wherein the female electrical-terminal defines an open distal-end and a channel opposite the web to receive the male electrical-terminal; and a contact-spring formed of a single piece of electrically conductive material disposed intermediate to the first-sidewall and the second-sidewall, said contact-spring defines a plurality of opposed-pair contact-beams, wherein each of the plurality of opposed-pair contact-beams have a plurality of outer-contact-points and have a plurality of inner-contact-points, wherein the plurality of outer-contact-points are in electrical and physical contact with the female electrical-terminal, and wherein the plurality of inner-contact-points are in electrical and physical contact with opposed sides of a male electrical-terminal such that a electrical and physical contact is formed between the contact beam, the female electrical-terminal, and the male electrical-terminal in at least four separate locations.

20. The female terminal assembly in accordance with claim 19, wherein the third-sidewall defines a plurality of weld-slots longitudinally extending from the medial-zone to the proximal-end, said plurality of weld-slots configured to interface with an electrical-cable sonically welded to the female electrical-terminal.

21. The female terminal assembly in accordance with claim 19, wherein the plurality of opposed-pair contact-beams are characterized as having a sinusoidally shaped cross-section.

22. The female terminal assembly in accordance with claim 19, wherein the plurality of inner-contact-points and the plurality of outer-contact-points are characterized as having a rounded shape.

23. The female terminal assembly in accordance with claim 19 wherein the contact-spring further includes a pair of opposing guide-ribs formed in leading-edges of the contact-spring, said pair of opposing guide-ribs configured to engage and align the male electrical-terminal upon insertion into the female electrical-terminal and thereby reduce a transverse-movement of the male electrical-terminal when the male electrical-terminal is in a seated-position.

24. The female terminal assembly in accordance with claim 19, wherein the contact-spring is characterized as having a U-shape.

* * * * *